US009492721B2

(12) United States Patent
Ghods et al.

(10) Patent No.: US 9,492,721 B2
(45) Date of Patent: Nov. 15, 2016

(54) GOLF CLUB HEADS WITH AERODYNAMIC FEATURES AND RELATED METHODS

(71) Applicant: Karsten Manufacturing Corporation, Phoenix, AZ (US)

(72) Inventors: Sina Ghods, Scottsdale, AZ (US); Xiaojian Chen, Phoenix, AZ (US); Ryan M. Stokke, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 14/882,092

(22) Filed: Oct. 13, 2015

(65) Prior Publication Data

US 2016/0114227 A1 Apr. 28, 2016

Related U.S. Application Data

(60) Provisional application No. 62/190,593, filed on Jul. 9, 2015, provisional application No. 62/184,719, filed on Jun. 25, 2015, provisional application No. 62/067,925, filed on Oct. 23, 2014.

(51) Int. Cl.
*A63B 53/04* (2015.01)

(52) U.S. Cl.
CPC ..... *A63B 53/0466* (2013.01); *A63B 60/52* (2015.10); *A63B 2053/0408* (2013.01); *A63B 2053/0416* (2013.01); *A63B 2053/0433* (2013.01); *A63B 2053/0491* (2013.01); *A63B 2225/01* (2013.01)

(58) Field of Classification Search
CPC ..... A63B 53/0466
See application file for complete search history.

(56) References Cited

U.S. PATENT DOCUMENTS

| | | | | |
|---|---|---|---|---|
| 5,435,558 | A * | 7/1995 | Iriarte | A63B 53/04 473/327 |
| 5,980,394 | A * | 11/1999 | Domas | A63B 53/04 273/DIG. 14 |
| 8,257,195 | B1 | 9/2012 | Erickson | |
| 8,328,661 | B1 | 12/2012 | Erickson | |
| 8,414,420 | B1 | 4/2013 | Erickson | |
| 8,425,346 | B1 | 4/2013 | Erickson | |
| D686,290 | S | 7/2013 | Kim et al. | |
| 8,696,491 | B1 * | 4/2014 | Myers | A63B 53/06 473/334 |
| 8,753,224 | B1 * | 6/2014 | Kim | A63B 53/0466 473/327 |
| 8,771,101 | B2 * | 7/2014 | Albertsen | A63B 53/0466 473/327 |
| 8,821,309 | B2 * | 9/2014 | Boyd | A63B 53/0466 473/305 |
| 8,900,070 | B1 | 12/2014 | Dawson et al. | |
| 8,926,448 | B1 | 1/2015 | Ivanova et al. | |
| 8,932,149 | B2 * | 1/2015 | Oldknow | A63B 53/0466 473/327 |

OTHER PUBLICATIONS

Journal of Fluids and Structures, "Drag reduction induced by the addition of a multi-cavity at the base of a bluff body", A. Martin-Alcantara et al., Jul. 2014, vol. 48, pp. 347-361.

* cited by examiner

*Primary Examiner* — Michael Dennis

(57) ABSTRACT

Embodiments of golf club heads with aerodynamic features and related methods are described herein. Various embodiments of the golf club heads with aerodynamic features and related methods include a golf club head comprising a body. In many embodiments, the body comprises a strikeface, a heel region, a toe region opposite the heel region, a sole, a crown, a trailing edge between the sole and the crown, a back opposite the strikeface, and one or more cavities located at least at one of: the back and in the sole adjacent to the trailing edge; or the back and in the trailing edge. Other examples and related methods are also disclosed herein.

11 Claims, 8 Drawing Sheets

1300

1400

GOLF CLUB HEADS WITH AERODYNAMIC FEATURES AND RELATED METHODS

CROSS-REFERENCE TO RELATED APPLICATIONS

This claims priority to U.S. Provisional Patent Application No. 62/190,593, filed on Jul. 9, 2015, U.S. Provisional Patent Application No. 62/184,719, filed on Jun. 25, 2015, and U.S. Provisional Patent Application No. 62/067,925, filed on Oct. 23, 2014. The disclosures of the referenced applications are incorporated herein by reference.

TECHNICAL FIELD

This disclosure relates generally to golf clubs, and relates more particularly to golf club heads with aerodynamic features.

BACKGROUND

Golf club manufacturers have designed golf club heads with aerodynamic features to improve the flow of air over and around the golf club head. When air flows around a golf club head during a swing of a golf club, a wake, or an area of disturbed air flow, is formed behind the golf club head. In many cases, the wake creates a drag force on the golf club head, thereby slowing the speed of the golf club head throughout the swing. Thus, some golf club heads can be designed to lessen the disturbed air flow during the swing.

BRIEF DESCRIPTION OF THE DRAWINGS

To facilitate further description of the embodiments, the following drawings are provided in which.

Figure 1:
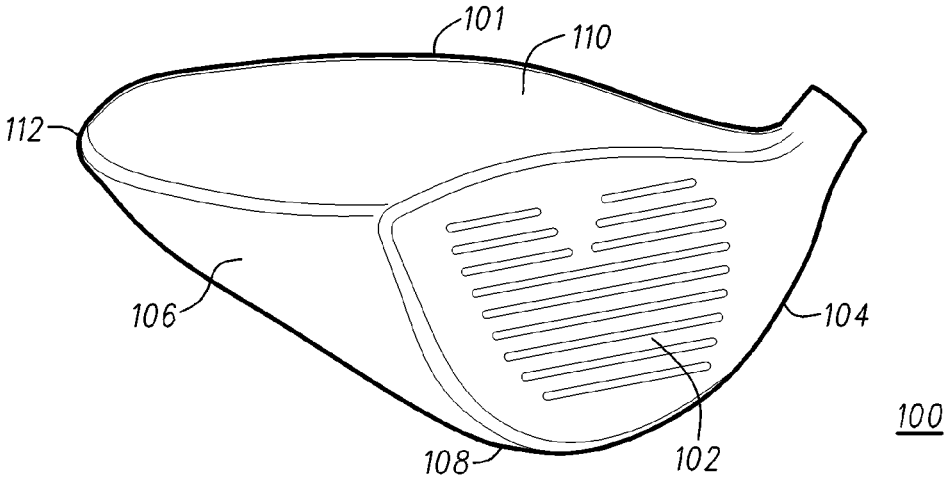
FIG. 1 depicts a front, toe-side perspective view of a golf club head according to an embodiment.

For simplicity and clarity of illustration, the drawing figures illustrate the general manner of construction, and descriptions and details of well-known features and techniques may be omitted to avoid unnecessarily obscuring the golf clubs and their methods of manufacture. Additionally, elements in the drawing figures are not necessarily drawn to scale. For example, the dimensions of some of the elements in the figures may be exaggerated relative to other elements to help improve understanding of embodiments of the golf clubs and their methods of manufacture. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of golf clubs and methods of manufacture described herein are, for example, capable of operation in sequences other than those illustrated or otherwise described herein. Furthermore, the terms "contain," "include," and "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "side," "under," "over," and the like in the description and in the claims, if any, are used for descriptive purposes and not necessarily for describing permanent relative positions. It is to be understood that the terms so used are interchangeable under appropriate circumstances such that the embodiments of golf clubs and methods of manufacture described herein are, for example, capable of operation in other orientations than those illustrated or otherwise described herein. The term "coupled," as used herein, is defined as directly or indirectly connected in a physical, mechanical, or other manner.

DETAILED DESCRIPTION

Various embodiments of the golf club heads with aerodynamic features and related methods include a golf club head comprising a body. In many embodiments, the body comprises a strikeface, a heel region, a toe region opposite the heel region, a sole, a crown, a trailing edge between the sole and the crown, a back opposite the strikeface, and one or more cavities located at least at one of: the back and in the sole adjacent to the trailing edge; or the back and in the trailing edge.

Other embodiments of the golf club heads with aerodynamic features and related methods include a golf club comprising a shaft, a grip, and a golf club head. The golf club head further comprises a body. In many embodiments, the body comprises a strikeface, a heel region, a toe region opposite the heel region, a sole, a crown, a trailing edge between the sole and the crown, a back opposite the strikeface, and one or more cavities located at least at one of: the back and in the sole adjacent to the trailing edge; or the back and in the trailing edge.

Other embodiments of the golf club heads with aerodynamic features and related methods include a method for manufacturing a golf club head. The method comprises forming a body from a first material having a first density, the body comprising a strikeface, a heel region, a toe region opposite the heel region, a sole, a crown, a trailing edge between the sole and the crown, and a back opposite the strikeface. In many embodiments, the method further comprises forming one or more cavities at the back and in the sole adjacent to the trailing edge. In some embodiments, the method further comprises forming a faceplate and attaching the faceplate to the body.

Turning to the drawings, FIG. 1 illustrates a front, toe-side perspective view of an embodiment of a golf club head 100. In some embodiments, golf club head 100 can be a driver-type golf club head. In other embodiments, golf club head 100 can be a wood-type, fairway wood, or a hybrid-type golf club head. Golf club head 100 comprises a body 101. In some embodiments, body 101 is molded as a single piece. In many embodiments, body 101 comprises a strikeface 102, a heel region 104, a toe region 106 opposite heel region 104, a sole 108, a crown 110, and a back 112 opposite strikeface 102. In many embodiments, strikeface 102 comprises a faceplate (i.e., faceplate 609 (FIG. 6)). In some embodiments, the faceplate is attached to the body. In many embodiments, the faceplate is attached to the body by welding. In some embodiments, a trailing edge is located at back 112 and between crown 110 and sole 108.

Figure 13:
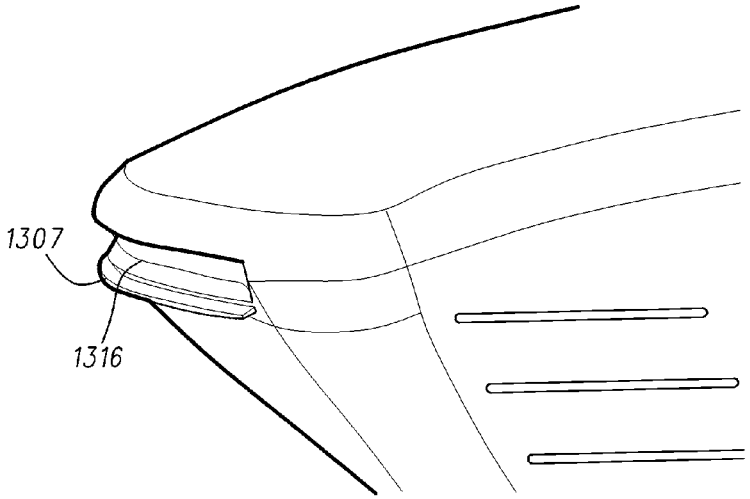
FIG. 13 depicts a front, toe perspective view of a golf club head according to another embodiment.
Figure 15:
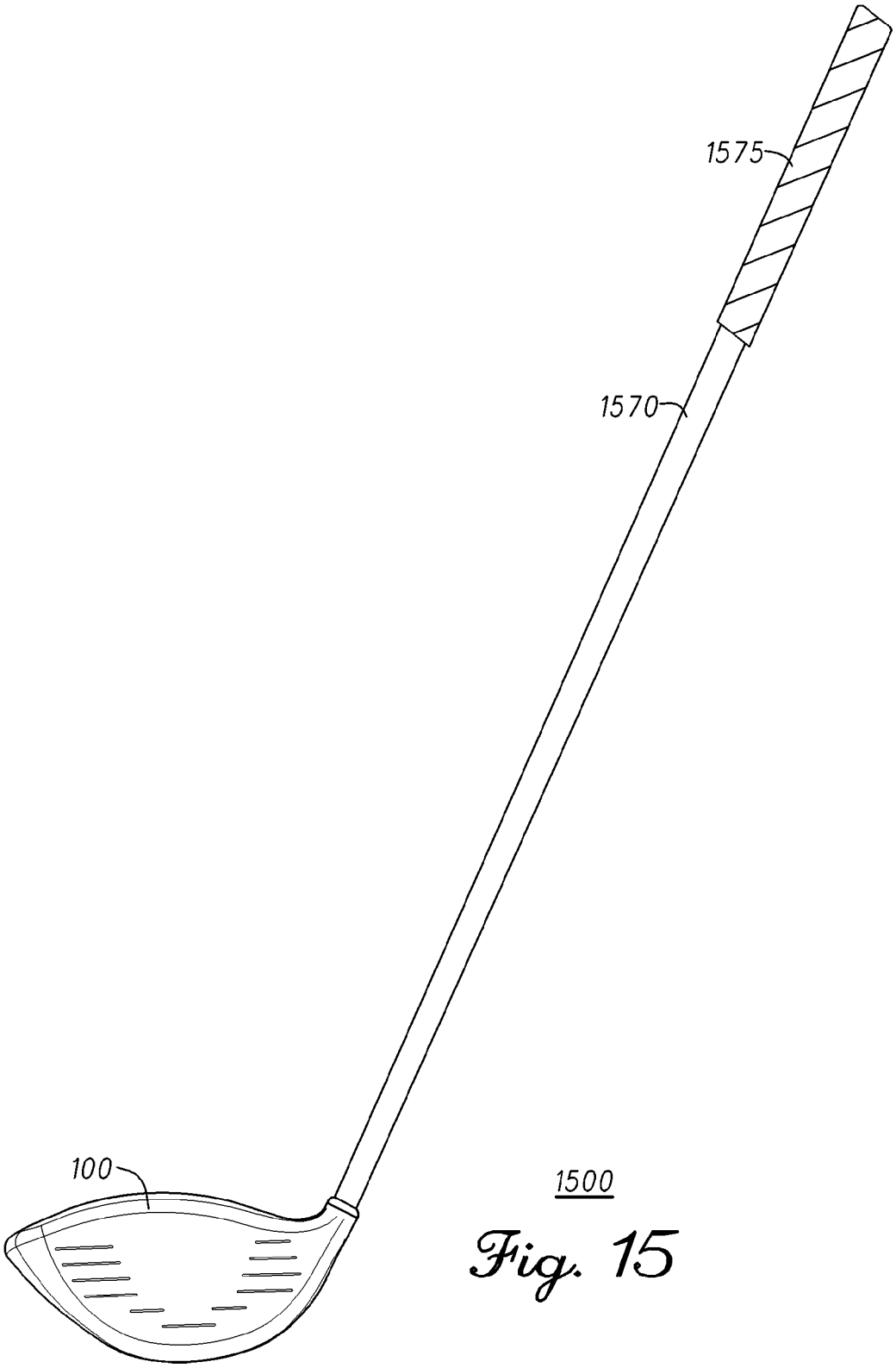
FIG. 15 depicts a golf club comprising the golf club head according to the embodiment of FIG. 1.

Golf club head 100 can be part of a corresponding golf club. For example, a golf club 1500 (FIG. 15) can comprise golf club head 100 coupled to a shaft 1570 and a grip 1575 opposite golf club head 100. Golf club 1500 can comprise any of the golf club head embodiments described herein, including golf club head 100 (FIGS. 1, 2, and 6-8), golf club head 300 (FIG. 3), golf club head 400 (FIG. 4), golf club head 500 (FIG. 5), golf club head 700 (FIG. 7), golf club head 900 (FIG. 9-10), and/or golf club head 1300 (FIG. 13). Further, the golf club head can be part of a set of golf club heads, and/or the golf club can be part of a set of golf clubs. Generally, club head 100 can comprise any suitable materials, but in many embodiments, club head 100 comprises one or more metal materials. Notwithstanding the foregoing, the apparatus, methods, and articles of manufacture described herein are not limited in this regard.

Figure 2:
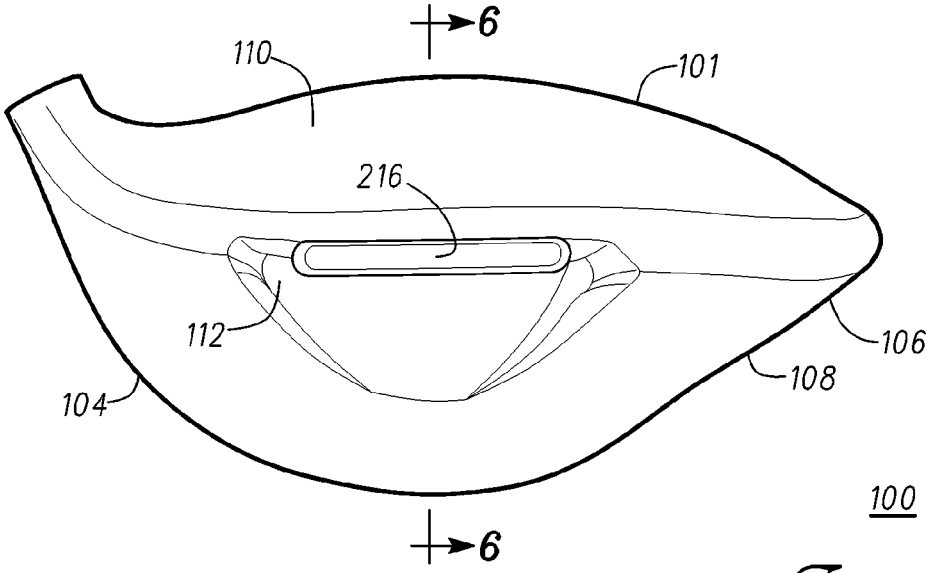
FIG. 2 depicts a back view of a golf club head according to the embodiment of FIG. 1.

In many embodiments, body 101 further comprises one or more internal and external cavities. Turning to FIG. 2, body 101 further comprises cavity 216, which is an external cavity. In some embodiments, cavity 216 is located in sole 108 and at back 112. In other embodiments, cavity 216 is located at the back and in the sole adjacent to the trailing edge of golf club head 100. In some embodiments cavity 216 is located at the back and in the trailing edge. In some embodiments, cavity 216 can be referred to as a channel, a recess, or a cutout. In many embodiments, cavity 216 is not located at, above, or within crown 110. In many embodiments as shown in FIGS. 1-2, the back half of crown 110 does not form any part of cavity 216. In many embodiments, crown 110 comprises no inflection points toward back 112 and/or above the location of cavity 216 at the rear-side of crown 110.

The air flowing around a body, such as golf club head 100, that is swung in the air can be unsteady and turbulent. In many instances, the wake that forms behind the body can be a source of instabilities and can be responsible for the appearance of fluctuating forces on the body, which, in many cases, contributes to a drag coefficient for the body. In fluid dynamics, vortices are shed in an oscillating flow when air flows past a body, such as golf club head 100. This vortex shedding depends on the size and shape of the body, or the size and shape of golf club head 100. In many embodiments, cavity 216 can break vortices generated behind golf club head 100 into smaller vortices to reduce the size of the wake and/or reduce drag. In some embodiments, breaking the vortices into smaller vortices can generate a region of high pressure behind golf club head 100. In some embodiments, this region of high pressure can push golf club head 100 forward, reduce drag, and/or enhance the aerodynamic design of golf club head 100. In many embodiments, the net effect of smaller vortices and reduced drag is an increase in the speed of golf club head 100. This effect can lead to higher speeds at which a golf ball leaves strikeface 102 (FIG. 1) after impact. In many embodiments, the construction of cavity 216 does not significantly affect the low center of gravity (CG) position of golf club head 100. In some embodiments, the presence of cavity 216 may lower the center of gravity of the club head and decrease the back spin on the golf ball.

Figure 6:
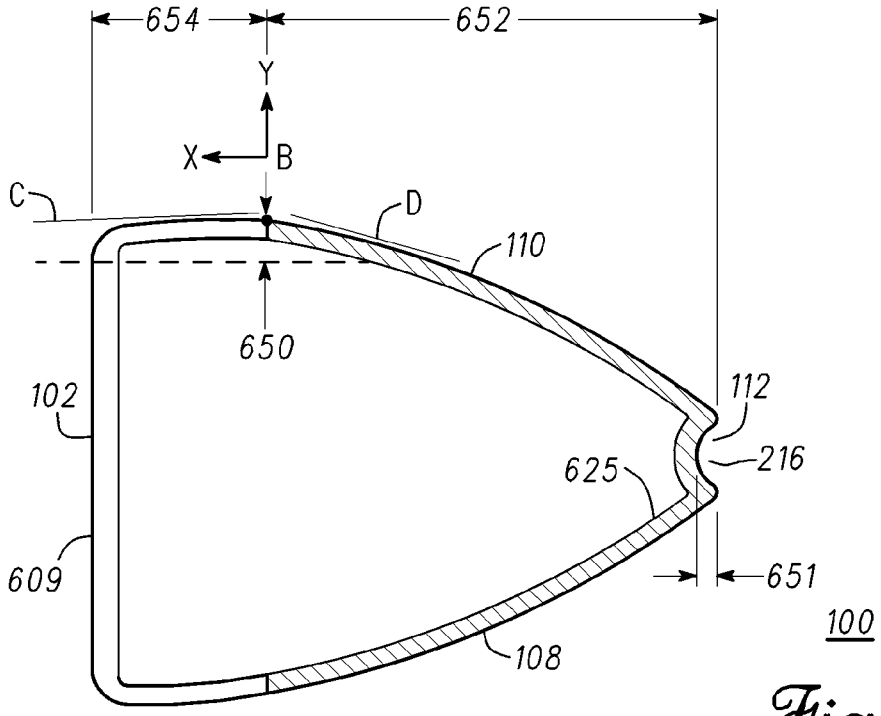
FIG. 6 depicts a cross-sectional view of the golf club head of FIG. 2 along the cross-sectional line 6-6 in FIG. 2.
Figure 7:
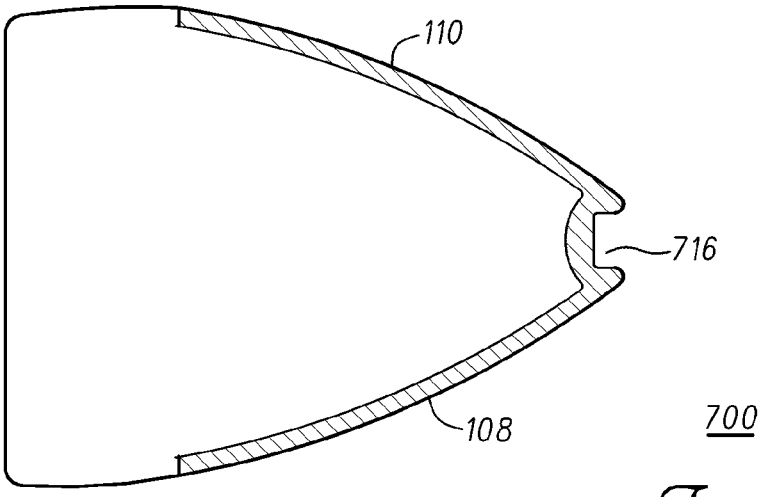
FIG. 7. depicts a cross-sectional view of the golf club head of FIG. 2 along the cross-sectional line 6-6 in FIG. 2.

In some embodiments, crown 110 comprises a single inflection point. For example, FIG. 6 shows golf club head 100 along cross-sectional line 6-6 of FIG. 2. In some embodiments, crown 110 comprises a single inflection point B over the surface of crown 110. The inflection point is a point on the external curve of crown 110 at which the sign of the curvature changes. From an origin of inflection point B on a x-y coordinate system, it can be seen that a line C tangent to crown 110 and located at a point between inflection point B and strikeface 102, has a negative slope. While a line D tangent to crown 110, and located at a point between back 112 and inflection point B, has a positive slope. The single inflection point characteristic for crown 110 can be limited to the rear part of crown 110 and can exclude any features located in front of the inflection point and toward strikeface 102, and such features can be excluded even if they extend from the front part of crown 110 to the rear part of crown 110. Such features can include the turbulators taught by U.S. Pat. No. 8,608,587, entitled "Golf Club Heads with Turbulators and Methods to Manufacture Golf Club Heads with Turbulators," which is herein incorporated by reference.

As also shown in FIG. 6, in many embodiments, cavity 216 can reduce the overall volume of body 101. For example, cavity 216, can comprise a channel or cutout of body 101 and is integral with body 101. In many embodiments, cavity 216 does not comprise an attachment to body 101.

Returning to FIG. 2, in some embodiments, cavity 216 can be located at a center region of back 112 of golf club head 100. In some embodiments, cavity 216 can be centered across back 112 between heel region 104 and toe region 106. In other embodiments, cavity 216 can be centered with strikeface 102. In some embodiments, cavity 216 can be aligned with the center of the wake or vortices caused by the air flow over and around golf club head 100. In embodiments wherein cavity 216 is aligned with the center of the wake, cavity 216 can break the vortices into smaller size vortices that are approximately the same smaller size to maximize the increase in pressure behind golf club 100.

Figure 5:
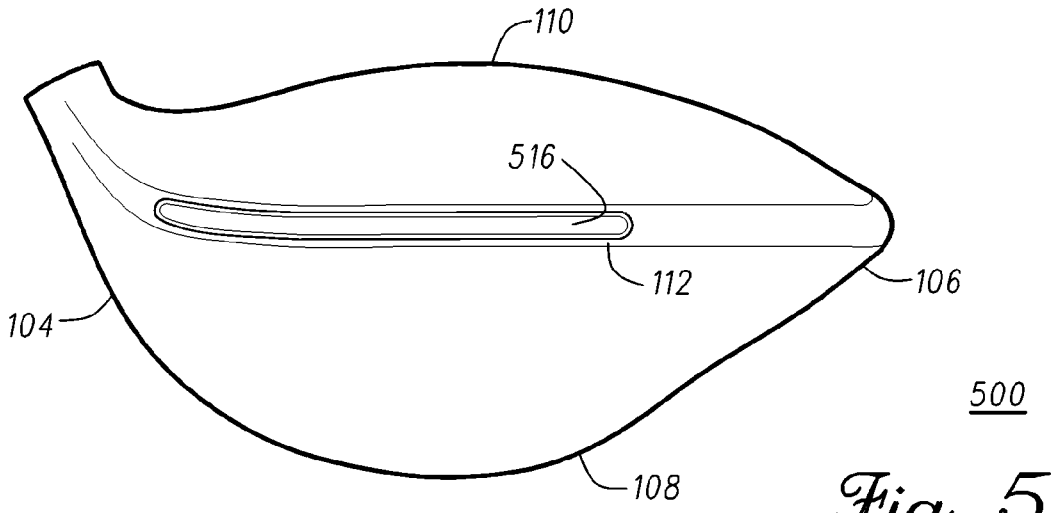
FIG. 5 depicts a back view of a golf club head according to a further embodiment.

In many embodiments, cavity 216 can be shifted along back 112 toward heel region 104, such as cavity 516 in FIG. 5. FIG. 5 illustrates a golf club head 500, which is similar to golf club head 100 (FIGS. 1-2). In many embodiments, cavity 516 can be located at back 112, below crown 110, and in sole 108 adjacent a trailing edge of golf club head 500. In other embodiments, cavity 516 is located at the back and in the sole adjacent to the trailing edge of golf club head 500. In some embodiments cavity 516 is located at the back and in the trailing edge. In some embodiments, cavity 516 is not centered at back 112, but instead can be shifted toward heel region 104. In some embodiments, cavity 516 can be shifted away from toe region 106.

In other embodiments, cavity 216 can be shifted along back 112 toward toe region 106. In some embodiments, cavity 216 can extend throughout a substantial length of back 112. In some embodiments there can be no cavity at heel region 104. In some embodiments, there can be no cavity at toe region 106.

In some embodiments, cavity 216 can be placed along back 112 of golf club head 100 to align with other features of golf club head 100. For example, cavity 216 can be aligned with a tapered sole weight as described in U.S. Pat. Pub. No. 2015/0031472, filed on Jul. 26, 2013 and entitled "Golf Club Heads with Sole Weights and Related Methods." In other embodiments, cavity 216 is not aligned with the weight-receiving cavity of the tapered sole weight.

Figure 8:
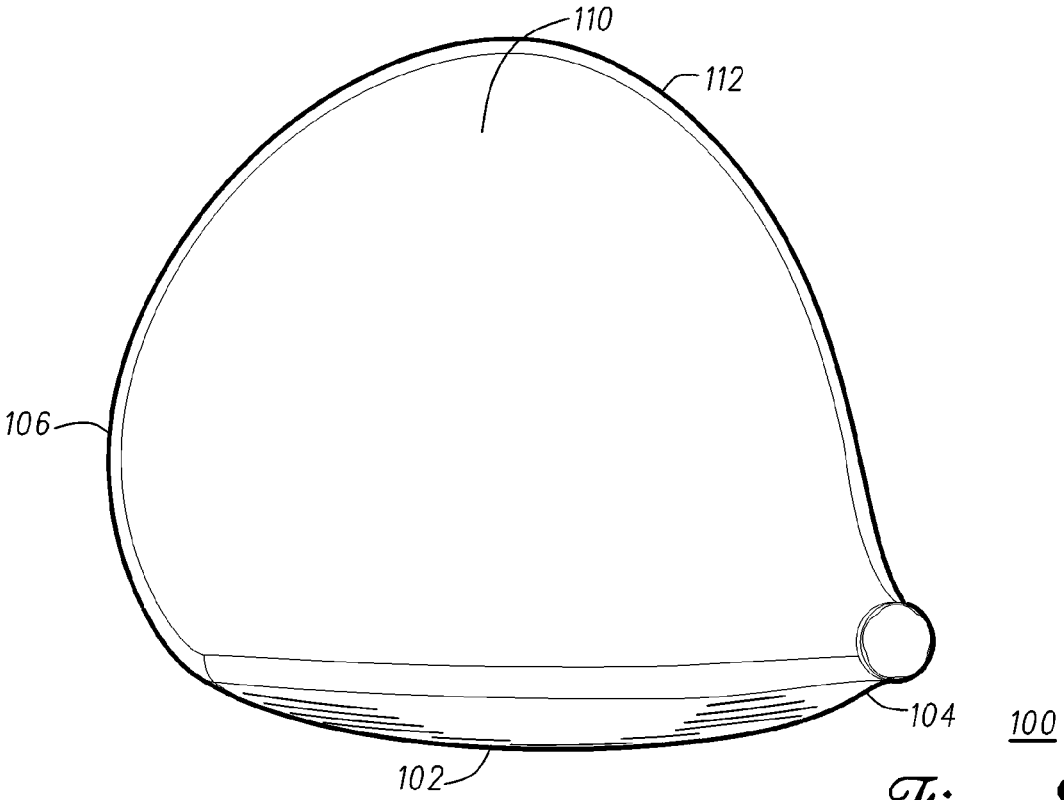
FIG. 8 depicts a top-down view of the golf club head according to the embodiment of FIG. 1.

In many embodiments, the cavity is not visible from a top-down view of golf club head. For example, FIG. 2 shows cavity 216 located on sole 108 adjacent a trailing edge of golf club head 100, or an underside of back 112. In many embodiments, cavity 216 is not located on crown 110. FIG. 8 shows a top-down view of golf club head 100 (FIGS. 1-2) showing crown 110, back 112, toe region 106, heel region 104 and a portion of strikeface 102. However, cavity 216 (FIG. 2) is not visible from the top-down view of FIG. 8, and the portions of golf club head 100 in which cavity 216 is formed also are not visible from this view.

Figure 3:
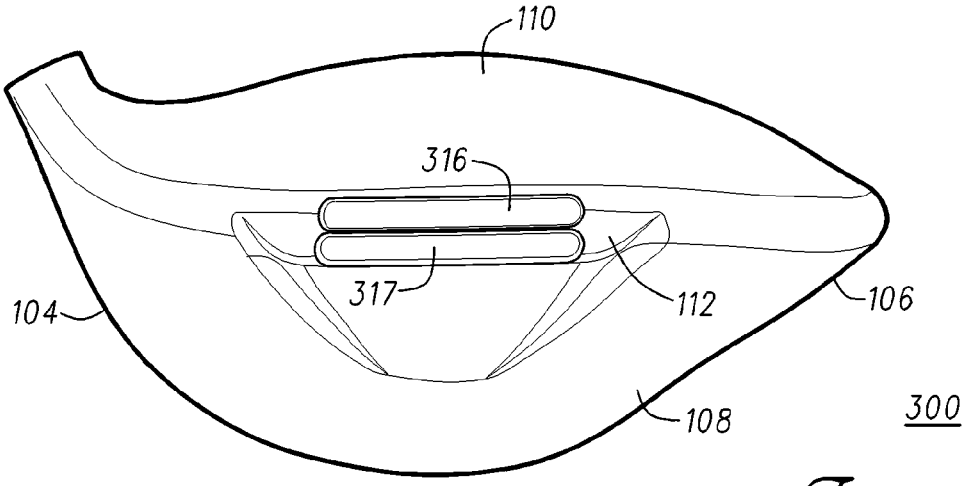
FIG. 3 depicts a back view of a golf club head according to another embodiment.

In some embodiments, two or more cavities can be stacked at back 112. FIG. 3 illustrates a back view of a golf club head 300. Golf club head 300 is similar to golf club head 100 (FIGS. 1-2). Golf club head 300 comprises two cavities 316 and 317. In many embodiments, cavities 316 and 317 are stacked, wherein cavity 316 is on top of or above cavity 317. Similar to cavity 216 (FIG. 2), cavities 316 and 317 can be located below crown 110 at the center region of back 112 in sole 108 adjacent the trailing edge of golf club head 300. In other embodiments, cavities 316 and 317 can be located at the back and in the sole adjacent to the trailing edge of golf club head 300. In some embodiments cavities 316 and 317 can be located at the back and in the trailing edge. In some embodiments, cavities 316 and 317 can be centered across back 112 between heel region 104 and toe region 106. In other embodiments, cavities 316 and 317 can be centered with strikeface 102. In many embodiments, cavities 316 and 317 can be shifted along back 112 toward heel region 104, such as cavity 516 in FIG. 5. In other embodiments, cavities 316 and 317 can be shifted along back 112 toward toe region 106. In some embodiments, cavities 316 and 317 can extend throughout a substantial length of back 112. In many embodiments, cavities 316 and 317 can be approximately the same length, height, and/or depth. In some embodiments, cavities 316 and 317 can have different lengths, heights, and/or depths. For example, cavity 317 can extend more toward heel region 104 than cavity 316, or cavity 316 can extend further toward heel region 104 than cavity 317. In some embodiments, cavity 316 can be offset from cavity 317.

Figure 4:
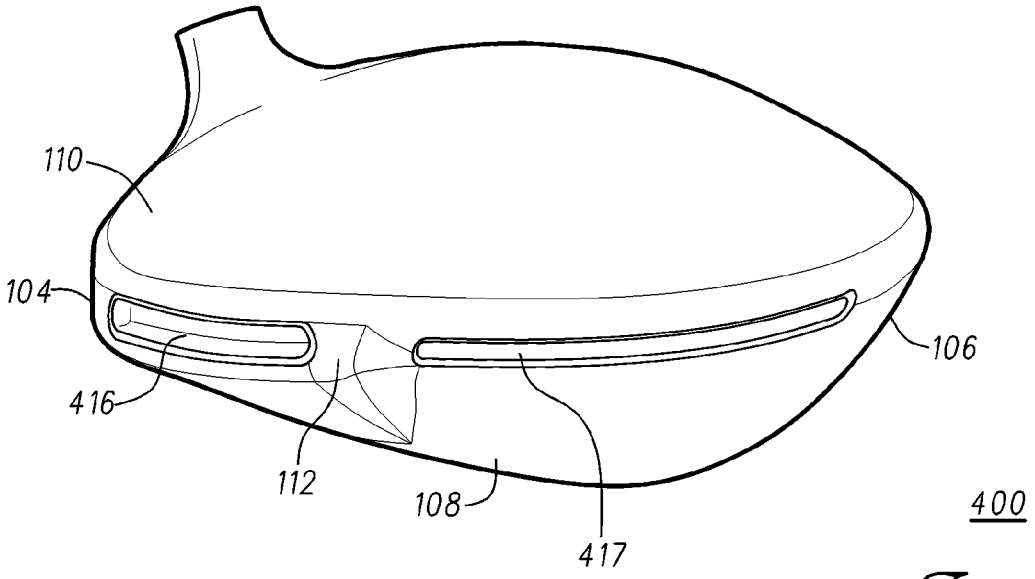
FIG. 4 depicts a back, toe perspective view of a golf club head of yet another embodiment.

FIG. 4 illustrates a back, toe perspective view of a golf club head 400, which is similar to golf club head 100 (FIGS. 1-2). In many embodiments, golf club head 400 comprises one or more cavities 416 and 417. Cavities 416 and 417 are similar to cavity 216 (FIG. 2) and are located at back 112, below crown 110, and in sole 108 adjacent to the trailing edge. In other embodiments, cavities 416 and 417 can be located at the back and in the sole adjacent to the trailing edge of golf club head 400. In some embodiments cavities 416 and 417 can be located at the back and in the trailing edge. In some embodiments, cavity 416 can be a back-center cavity, and cavity 417 can be a back-side cavity. In some embodiments, cavity 417 can be located toward toe region 106. In other embodiments, cavity 417 can be on located toward heel region 104.

In various embodiments, cavities 416, 417 are located side-by-side in a straight line, and can extend along back 112 from the center region of back 112 to toe region 106, as shown on golf club head 400 in FIG. 4. In other embodiments, cavities 416 and 417 can extend along back 112 from heel region 104 toward toe region 106. In some embodiments, one or more cavities 416 and 417 can extend along back 112 from heel region 104 to the center region of back 112. In some embodiments, cavity 417 can be continuous with cavity 416. In some embodiments, cavity 417 can connect with cavity 416. In other embodiments, cavity 416 and/or cavity 417 can be divided into three or more cavities.

In many embodiments, one or more cavities can have differently shaped inner profiles. FIG. 6 illustrates cavity 216 of golf club head 100 with an inner profile shape that is rounded. In other embodiments, cavity 216 of golf club head 100 can have a different inner profile shape, such as a flat or rectangular inner profile shape as shown for a cavity 716 in golf club head 700 in FIG. 7.

In some embodiments, body 101 of golf club head 600 can further comprise an offset thickness 625 at cavity 216, as shown in FIG. 6. In some embodiments, offset thickness 625 can be larger than the thickness of other portions of golf club head 600. In some embodiments, offset thickness 625 can have an offset thickness density greater than a body density of body 101. In other embodiments, the offset thickness density can be the same as the body density. In some embodiments, offset thickness 625 can provide structural support for body 101. In some and other embodiments, offset thickness 625 can provide added weight to back 112 of body 101.

Returning to FIG. 2, in some embodiments, cavity 216 can have a heel-to-toe width of approximately 1.75 inches (approximately 4.45 centimeters (cm)) to approximately 8 inch (approximately 20.32 cm). In some embodiments, cavity 116 can have a width of approximately 1.75 inches (approximately 4.45 cm) to approximately 2.25 inches (approximately 5.72 cm). In some embodiments, cavity 216 can have a width of approximately 2.0 inches (5.08 cm), 3.0 inches (7.62 cm), 4.0 inches (10.16 cm), 5.0 inches (12.7 cm), 6.0 inches (15.24 cm), or 7.0 inches (17.78 cm). In some embodiments, the width of cavity 216 can be larger at an upper region of cavity 216 closer to crown 110 than the width of cavity 216 at a lower region of cavity 216. In other embodiments, the width of cavity 216 can be smaller at an upper region of cavity 216 closer to crown 110 than the width of cavity 216 at a lower region of cavity 216.

In embodiments comprising more than one cavity, each cavity can have the same cavity width. In other embodiments comprising more than one cavity, each cavity can have different cavity widths. For example, FIG. 4 illustrates two cavities, cavity 416 and cavity 417 wherein cavity 416 has a cavity width smaller than the cavity width of cavity 417. In other embodiments, the cavity width of cavity 416 can be larger than the cavity width of cavity 417.

Returning again to FIG. 2, in some embodiments, cavity 216 can have a crown-to-sole cavity height of approximately 0.19 inch (approximately 0.48 cm) to approximately 0.21 inch (approximately 0.53 cm). In some embodiments, cavity 216 can have a cavity height of approximately 0.20 inch (approximately 0.51 cm). In embodiments comprising more than one cavity, each cavity can have the same cavity height. In some embodiments comprising more than one cavity, each cavity can have different cavity heights. For example, FIG. 4 illustrates two cavities, cavity 416 and cavity 417 wherein cavity 416 has a cavity height substantially similar to the cavity height of cavity 417. In other embodiments, the cavity height of cavity 416 can be larger than the cavity height of cavity 417. In other embodiments, the cavity height of cavity 416 can be smaller than the cavity height of cavity 417.

In other embodiments, if there are more than one cavity and the cavities are stacked, such as cavities 316 and 317 in FIG. 3, each cavity 316 and 317 can have a cavity height of approximately 0.19 inch (approximately 0.48 cm) to approximately 0.21 inch (approximately 0.53 cm). In other embodiments, cavities 316 and 317 can have a total combined maximum height of approximately 0.19 inch (approximately 0.48 cm) to approximately 0.21 inch (approximately 0.53 cm). In some embodiments, cavities 316 and 317 can each have cavity heights that are substantially equal. In other embodiments, cavity 316 can have a cavity height larger than the cavity height of cavity 317. In other embodiments, cavity 316 can have a cavity height smaller than the cavity height of cavity 317.

Figure 9:
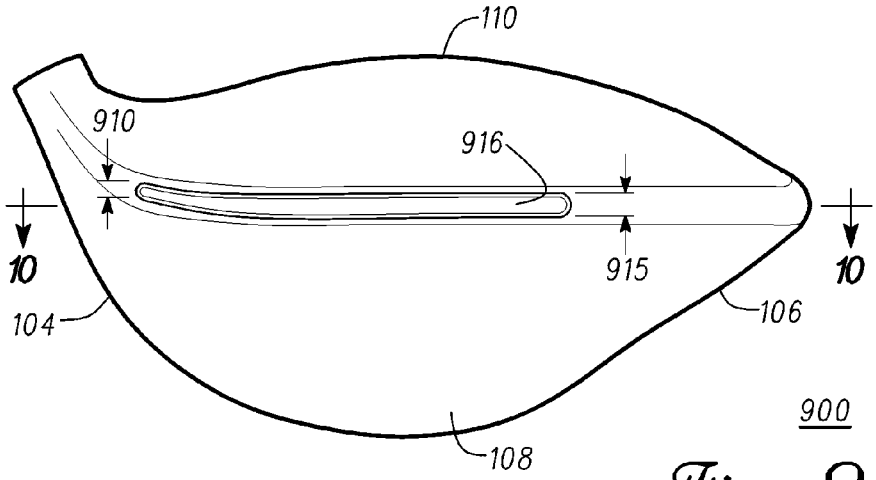
FIG. 9 depicts a back view of a golf club head according to another embodiment.

In some embodiments, the cavity height of one or more cavities can vary throughout the cavity. FIG. 9 illustrates a golf club head 900 with a cavity 916, wherein cavity 916 can have a varying height. Golf club head 900 can be similar to golf club head 100. In many embodiments, cavity 916 is located below crown 110 and in sole 108 adjacent the trailing edge. In other embodiments, cavity 916 is located at the back and in the sole adjacent to the trailing edge of golf club head 100. In some embodiments cavity 916 is located at the back and in the trailing edge. In some embodiments, cavity 916 has a toe-side height 915 toward the toe region end of cavity 916 which can be greater than a heel-side height 910 at the heel region end of cavity 916. In some embodiments, the cavity height of cavity 916 can vary throughout or only partially throughout the length of cavity 916. In some embodiments, heel-side height 910 can be greater than toe-side height 915. In other embodiments, cavity 916 can have a maximum height at the center and the same or different smaller heights at the heel region end or the toe region end of cavity 916.

Returning to FIG. 2, in some embodiments, cavity 216 can have a cavity depth of approximately 0.025 inch (approximately 0.127 cm) to approximately 0.250 inch (approximately 0.635 cm). In some embodiments, the cavity depth of cavity 216 can be approximately 0.025 inch (approximately 0.127 cm) to approximately 0.150 inch (approximately 0.381 cm). In many embodiments, the cavity depth of cavity 216 can be approximately 0.1 inch (approximately 0.254 cm). In many embodiments, the cavity depth of cavity 216 can be approximately 0.05 inch (approximately 0.127 cm).

Figure 10:
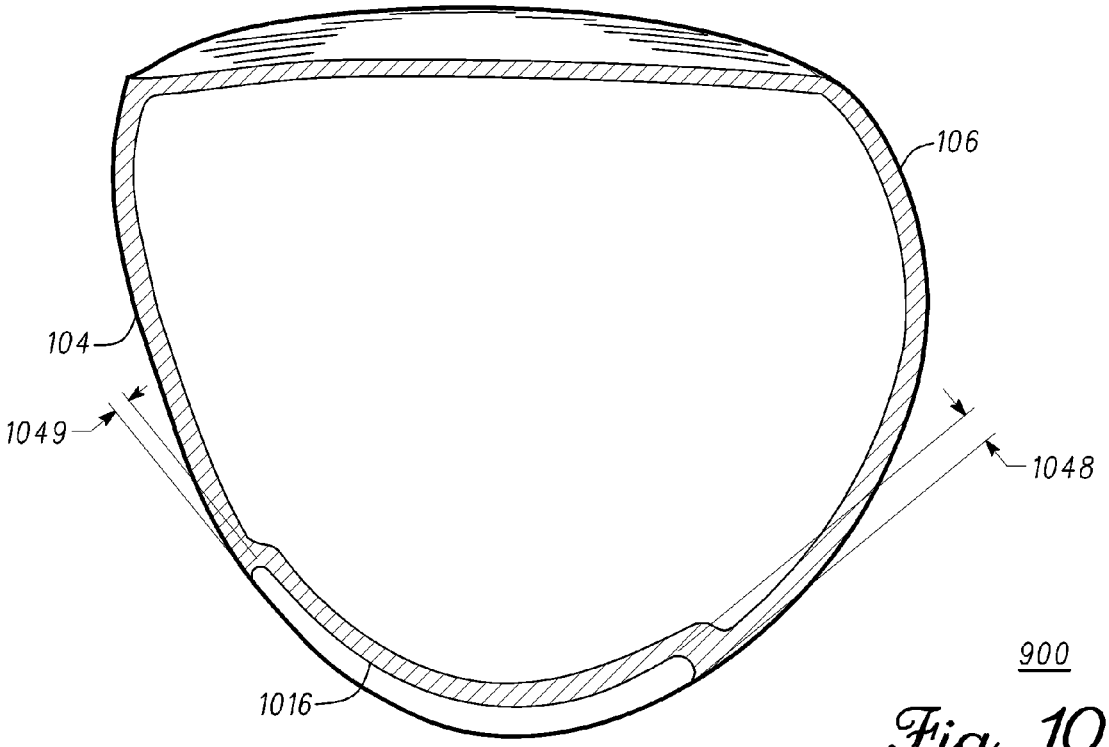
FIG. 10 depicts a cross-sectional view the golf club head of FIG. 9 along the cross-sectional line 10-10 in FIG. 9.

FIG. 10 illustrates golf club head 900 along cross-sectional line 10-10 in FIG. 9. Golf club head 900 is similar to golf club head 100. In some embodiments, golf club head 900 can comprise a cavity 1016, wherein cavity 1016 can have a varying depth. In some embodiments, cavity 1016 can have a toe-side depth 1048 located toward toe region 106 that is greater than a heel-side depth 1049 located toward heel region 104. In other embodiments, the depth of cavity 1016 can vary throughout the length of cavity 1016. In some embodiments, heel-side depth 1049 can be greater than toe-side depth 1048. In other embodiments, cavity 1016 can have a maximum depth at the center of golf club head 900 and cavity 1016, and shallower depths at toe region 106 end and heel region 104 end of cavity 1016.

In some embodiments, the cavity depth can correspond to an apex height of the golf club and an apex position relative to the strikeface and the back. In FIG. 6, apex height 650 is shown measured from a top of strikeface 102 to the maximum height or highest point of crown 110 of golf club head 400. In some embodiments, strikeface 102 comprises faceplate 609. In many embodiments, apex height 650 is located at inflection point B. A back apex position 652 is measured from back 112 to apex height 650, and a strikeface apex position 654 is measured from apex height 650 to strikeface 102. In some embodiments, the relationship of apex height 650, back apex position 652, and strikeface apex position 654 can be represented by Relation 1.

$$X=H*(D_b-D_f) \quad \text{(Relation 1)}$$

In Relation 1, H is the apex height (i.e., apex height 650), $D_f$ is the distance from the apex to the strikeface (i.e., strikeface apex position 654), and $D_b$ is the distance from the apex to the back (i.e., back apex position 652). Furthermore, the relationship of X (apex height (H) times distance of apex to back ($D_b$) minus distance from apex to strikeface ($D_f$) to cavity depth 651 can be represented by Relation 2.

$$X/C_d \quad \text{(Relation 2)}$$

In Relation 2, $C_d$ is cavity depth (i.e., cavity depth 651). As discussed above, one cavity depth ($C_d$) may be 0.100 inches. In one embodiment, a club head having the cavity 216 may have an apex height (H) of 0.316 inches (0.803 cm), a distance from the apex to the back (Db) of 3.761 inches (9.553 cm), a distance from the apex to the strikeface ($D_f$) of 0.700 inches (1.778 cm) to equate to an X value of 0.967 inches$^2$ (2.456 cm$^2$). Using Relation 2, the ratio of $X/C_d$ would equal 9.67 inches (25.56 cm).

In another embodiment, the cavity depth ($C_d$) may be 0.050 inches (0.127 cm). The cavity 216 may have an apex height (H) of 0.316 inches (0.803 cm), a distance from the apex to the back (Db) of 3.761 inches (9.553 cm), a distance from the apex to the strikeface ($D_f$) of 0.700 inches (1.778 cm) to equate to an X value of 0.967 inches$^2$ (2.456 cm$^2$). Using Relation 2, the ratio of $X/C_d$ would equal 19.34 inches (49.12 cm).

In some embodiments, the ratio of $X/C_d$ may range from 7-11 inches (17.8-27.9 cm). In some embodiments, the ratio of $X/C_d$ may be approximately 7 (17.8), 7.2 (18.3), 7.4 (18.8), 7.6 (19.3), 7.8 (19.8), 8.0 (20.3), 8.2 (20.8), 8.4 (21.3), 8.6 (21.8), 8.8 (22.4), 9.0 (22.9), 9.2 (23.4), 9.4 (23.9), 9.6 (24.4), 9.8 (24.9), 10.0 (25.4), 10.2 (25.9), 10.4 (26.4), 10.6 (26.9), 10.8 (27.4), or 11.0 (27.9) inches (cm). In some embodiments, the ratio of $X/C_d$ may be greater than 7 inches (17.8 cm). In some embodiments, the ratio of $X/C_d$ may range from 3.5-38 inches (8.9-96.5 cm). In some embodiments, the ratio may be approximately 3.5 (8.9), 4.5 (11.4), 5.5 (14.0), 6.5 (16.5), 7.5 (19.0), 8.5 (21.6), 9.5 (24.1), 10.5 (26.7), 11.5 (29.2), 12.5 (31.8), 13.5 (34.3), 14.5 (36.8), 15.5 (39.4), 16.5 (41.9), 17.5 (44.5), 18.5 (47.0), 19.5 (49.5), 20.5 (52.1), 21.5 (54.6), 22.5 (57.2), 23.5 (59.7), 24.5 (62.2), 25.5 (64.8), 26.5 (67.3), 27.5 (69.9), 28.5 (72.4), 29.5 (74.9), 30.5 (77.5), 31.5 (80.0), 32.5 (82.6), 33.5 (85.1), 34.5 (87.6), 35.5 (90.2), 36.5 (92.7), or 37.5 (95.3) inches (cm). In some embodiments, the ratio of $X/C_d$ may be greater than 3.5 inches (8.9 cm). In some embodiments, the ratio of $X/C_d$ may range from 9-20 inches (22.9-50.8 cm). In some embodiments, the ratio may be approximately 9.0 (22.9), 9.5 (24.1), 10.0 (25.4), 10.5 (26.7), 11.0 (27.9), 11.5 (29.2), 12.0 (30.5), 12.5 (31.8), 13.0 (33.0), 13.5 (34.3), 14.0 (35.6), 14.5 (36.8), 15.0 (38.1), 15.5 (39.4), 16.0 (40.6), 16.5 (41.9), 17.0 (43.2), 17.5 (44.5), 18.0 (45.7), 18.5 (47.0), 19.0 (48.3), 19.5

(49.5), or 20.0 (50.8) inches (cm). In some embodiments, the ratio of $X/C_d$ may be greater than 9 inches.

As X increases, the crown profile results in increased separation, and therefore, the cavity depth is greater to account for the increased separation. In some embodiments, as $D_b$ increases or as $D_f$ decreases, the crown profile results in increased separation, and therefore cavity depth should increase. In some embodiments, as H increases, the crown profile results in increased separation, and cavity depth should increase.

Figure 11:
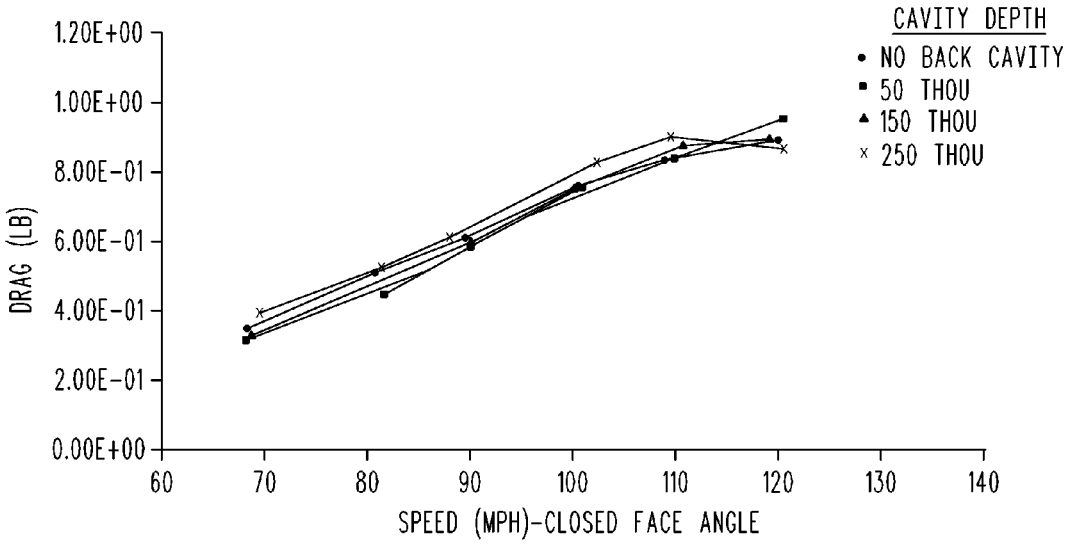
FIG. 11 depicts a chart of drag forces in pounds (lbs) versus golf club head speed in miles per hour (mph) according to four different embodiments.

FIG. 11 illustrates a chart of drag forces in pounds (lbs) versus golf club head speed in miles per hour (mph) for four golf club heads of varying cavity depth (i.e., no cavity, approximately 0.050 inch depth (approximately 0.127 cm), approximately 0.150 inch depth (approximately 0.381 cm), and approximately 0.250 inch depth (approximately 0.635 cm).

Figure 12:
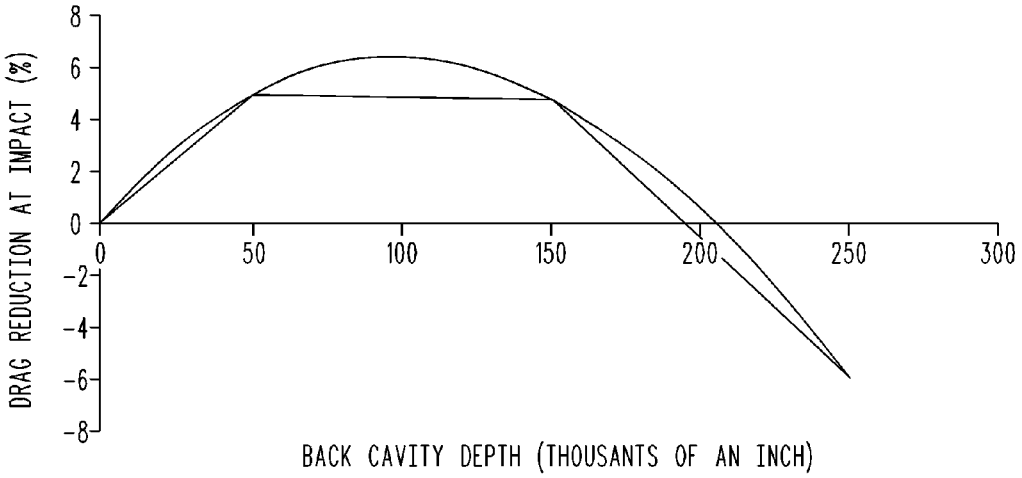
FIG. 12 depicts a chart of percent drag reduction at impact according to the four different embodiments of FIG. 11.

FIG. 12 illustrates a chart of percent drag reduction at impact for each of the four golf club heads having varying cavity depth as mentioned in FIG. 11. A curve was fitted to the data to determine the impact cavity depth has on reducing drag on the golf club head at impact. If the cavity is too deep, the fluid or air flow cannot follow the cavity curvature, which therefore can result in fluid or air flow separation. Fluid or air flow separation can increase drag on the golf club head.

Returning to FIG. 2, when golf club head 100 is at an address position, golf club head 100 is at a closed club face angle, for example, 90 degrees to a drag force. At the closed club face angle, or 90 degrees to the drag force, cavity 216 can improve drag reduction by approximately 6 percent to approximately 12 percent. During a downswing, golf club head 100 is at an open club face angle of approximately 0 degrees to approximately 89 degrees to the drag force. In some embodiments, at approximately 50 degrees, cavity 216 can improve drag reduction by approximately 0.1 percent to approximately 3 percent. In some embodiments, vortex shedding behind golf club head 100 is shifted toward toe region 106 for open club face angles. In these embodiments, cavity 216 can be extended toward toe region 106 to improve drag reduction at open club face angles.

Computational Fluid Dynamics (CFD) simulations of a single back cavity extended toward the toe applied to the body of a driver-type golf club head show around 10 percent drag reduction at the impact point and around 3 percent drag reduction for the open face angles. Table 1, below, shows drag reductions from adding different vortex disruptors to a driver-type golf club head. In many embodiments, cavity 216 (FIG. 2) reduces drag during the majority of the swing, including during impact with the golf ball.

TABLE 1

CFD Similations Showing Drag Reduction Using Different Vortex Disruptors

| Cavity | Close Face Angle (90°) | Open Face Angle (50°) |
|---|---|---|
| Single Back Cavity | 10% drag reduction | 0% drag reduction |
| Single Back Cavity and Side Cavity | 10% drag reduction | 3% drag reduction |
| Stacked Back Cavities | 7% drag reduction | 1% drag increase |

FIG. 13 illustrates a front, toe perspective view of a portion of a golf club head 1300. Golf club head 1300 is similar to golf club head 100 (FIG. 1). In various embodiments, golf club head 1300 comprises one or more cavities 1316. One or more cavities 1316 are similar to cavity 216 (FIG. 2). In some embodiments, cavity 1316 is located at the back and in the sole. In other embodiments, cavity 1316 is located at the back and in the sole adjacent to the trailing edge of golf club head 1300. In some embodiments cavity 1316 is located at the back and in the trailing edge. In some embodiments, a fin 1307 can extend off the bottom or lower edge of one or more cavities 1316. In some embodiments, fin 1307 is located at only a portion of one or more cavities 1316, for example at toe region 106. In other embodiments, fin 1307 is located throughout the entirety of the lower edge of one or more cavities 1316. Fin 1307 can be similar to a wing, a blade, or a spoiler. In some embodiments, fin 1307 can further reduce drag on golf club head 1300 during portions of a swing of golf club head 1300. In some embodiments, fin 1307 can reduce or delay air flow separation on golf club 1300.

Figure 14:
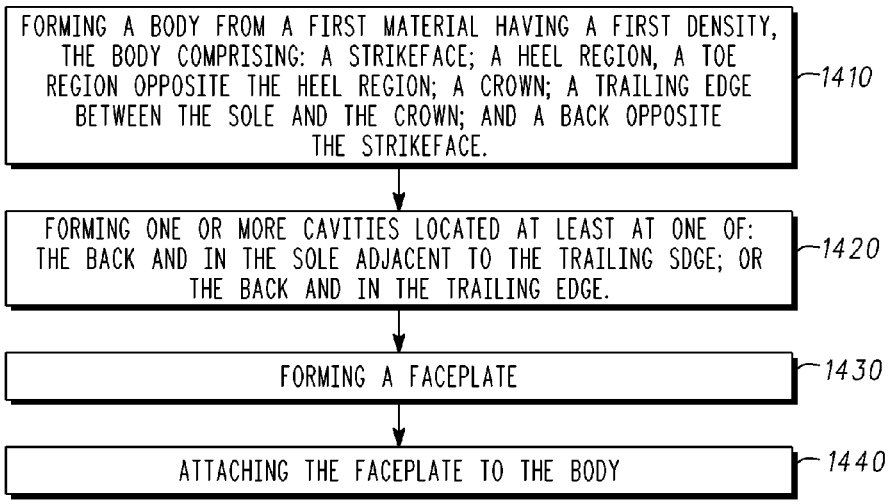
FIG. 14 depicts a method of manufacturing a golf club head according to an embodiment.

Some embodiments of golf club heads with aerodynamic features can include a method 1400, as shown in FIG. 14, for manufacturing a golf club head, such as golf club heads of FIGS. 1-10 and 13. Method 1400 is merely exemplary and is not limited to the embodiments presented herein. Method 1400 can be employed in many different embodiments or examples not specifically depicted or described herein. In some embodiments, the activities, the procedures, and/or the processes of method 1400 can be performed in the order presented. In other embodiments, the activities, the procedures, and/or the processes of method 1400 can be performed in any other suitable order. In still other embodiments, one or more of the activities, the procedures, and/or the processes in method 1400 can be combined or skipped. In many embodiments, the golf club head can be similar or identical to golf club head 100 (FIGS. 1, 2, 6-8, and 15), golf club head 300 (FIG. 3), golf club head 400 (FIG. 4), golf club head 500 (FIG. 5), golf club head 700 (FIG. 7), golf club head 900 (FIG. 9-10) and/or golf club head 1300 (FIG. 13).

In many embodiments, method 1400 comprises forming a body from a first material having a first density (block 1410). In many embodiments, forming a body in block 1410 comprises forming the body to comprise a strikeface, a heel region, a toe region opposite the heel region, a sole, a crown, a trailing edge, and a back opposite the strikeface. In many embodiments, method 1400 further comprises forming one or more cavities located at least at one of: the sole and at the back or the back and in the trailing edge (block 1420). In many embodiments, method 1400 further comprises forming a faceplate (block 1430) and attaching the faceplate to the body (block 1440). In some embodiments, attaching the faceplate to the body can comprise welding the strikeface to the body. In some embodiments, method 1400 can further comprise reinforcing the body by adding an offset thickness. In many embodiments, the offset thickness can be added inside the body at the back of the golf club head. In some embodiments, the body formed in method 1400 can further have a weight-receiving cavity. In many embodiments, the weight-receiving cavity can be formed as described in U.S. Pat. Pub. No. 2015/0031472, filed on Jul. 26, 2013 and entitled "Golf Club Heads with Sole Weights and Related Methods," which was incorporated by reference above. The weight-receiving cavity can open to an exterior sole surface and is bounded by an exterior port top surface and one or more port side walls. In many embodiments, a sole weight is conformal with the weight-receiving cavity. In some embodiments, one of the one or more cavities can be aligned with the weight-receiving cavity. In other embodiments, one of the one or more cavities is not aligned with the weight-receiving cavity and/or is aligned at the center of the back of the golf club head.

The golf club heads with aerodynamic features and related methods discussed herein may be implemented in a variety of embodiments, and the foregoing discussion of these embodiments does not necessarily represent a complete description of all possible embodiments. Rather, the detailed description of the drawings, and the drawings themselves, disclose at least one preferred embodiment of systems and methods for fitting golf club head weight, and may disclose alternative embodiments of golf club heads with cavities and related methods.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a driver-type golf club, the apparatus, methods, and articles of manufacture described herein may be applicable to other types of golf club such as a fairway wood-type golf club, a hybrid-type golf club, an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A golf club head comprising:
a body comprising:
a strikeface;
a heel region;
a toe region opposite the heel region;
a sole;
a crown having an apex;
a trailing edge between the sole and the crown;
a back opposite the strikeface; and
a cavity located at the back and in the trailing edge, wherein:
the cavity has a width between 4.45 centimeters (cm) and 5.72 cm and a depth of approximately 1.27 millimeters (mm) to 3.81 mm; and
the cavity is oriented in a direction perpendicular to a ground plane of the club head.

2. The golf club head of claim 1, wherein:
the cavity depth is approximately 2.54 mm.

3. The golf club head of claim 1, wherein:
the cavity depth is approximately 1.27 mm.

4. The golf club head of claim 1, further comprising a ratio of an apex position to the cavity depth; wherein,
the apex position is defined as an apex height multiplied by the difference between a distance from the apex to the back and a distance from the apex to the strikeface;
and the ratio is greater than approximately 8.9 centimeters.

5. The golf club head of claim 1, wherein:
the cavity comprises a cavity height of approximately 4.826 mm to approximately 5.334 mm.

6. The golf club head of claim 1, wherein:
an inner profile shape of the cavity is flat.

7. The golf club head of claim 1, wherein:
the body further comprises:
a weight-receiving cavity opening to an exterior sole surface and bounded by an exterior port top surface and one or more port side walls;
a sole weight is conformal with the weight-receiving cavity; and
the cavity is aligned with the weight-receiving cavity.

8. A golf club comprising:
a shaft;
a grip;
and
a golf club head comprising:
a body comprising:
a strikeface;
a heel region;
a toe region opposite the heel region;
a sole;
a crown having an apex;
a trailing edge between the sole and the crown;
a back opposite the strikeface; and
a cavity located at the back and in the trailing edge, wherein:
the cavity has a width between 4.45 centimeters (cm) and 5.72 cm and a
depth of approximately 1.27 millimeters (mm) to 3.81 mm; and
the cavity is oriented in a direction perpendicular to a ground plane of the club head.

9. The golf club of claim 8, further comprising a ratio of an apex position to the cavity depth; wherein,
the apex position is defined as an apex height multiplied by the difference between a distance from the apex to the back and a distance from the apex to the strikeface;
and the ratio is greater than approximately 8.9 centimeters.

10. The golf club of claim 8, wherein:
an inner profile shape of the cavity is flat.

11. The golf club of claim 8, wherein:
the body further comprises:
a weight-receiving cavity opening to an exterior sole surface and bounded by an exterior port top surface and one or more port side walls;
a sole weight is conformal with the weight-receiving cavity; and
the cavity is aligned with the weight-receiving cavity.

* * * * *